US008328113B2

(12) United States Patent
Stribling et al.

(10) Patent No.: US 8,328,113 B2
(45) Date of Patent: Dec. 11, 2012

(54) SNAP-FIT VALVE AND STRAW ASSEMBLY AND METHOD OF USING SAME

(75) Inventors: Robert Patton Stribling, Monroe, GA (US); Samuel Clifford Crosby, Lilburn, GA (US)

(73) Assignee: The Last Straw LLC, Monroe, GA (US)

( * ) Notice: Subject to any disclaimer, the term of this patent is extended or adjusted under 35 U.S.C. 154(b) by 463 days.

(21) Appl. No.: 12/616,596

(22) Filed: Nov. 11, 2009

(65) Prior Publication Data

US 2011/0108613 A1 May 12, 2011

(51) Int. Cl.

| | |
|---|---|
| ***A47G 21/18*** | (2006.01) |
| ***A47G 19/22*** | (2006.01) |
| ***B65D 83/00*** | (2006.01) |
| ***B65D 5/72*** | (2006.01) |
| ***B65D 25/40*** | (2006.01) |

(52) U.S. Cl. ..... 239/33; 215/388; 220/705; 222/490

(58) Field of Classification Search ..... 239/12, 239/33, 533.13, 569–571; 220/705, 714; 215/388; D7/300.2; 222/175, 490

See application file for complete search history.

(56) References Cited

U.S. PATENT DOCUMENTS

| | | | | |
|---|---|---|---|---|
| 5,730,336 | A * | 3/1998 | Lerner | 222/490 |
| 7,837,056 | B2 | 11/2010 | Stribling et al. | |
| 2005/0150894 | A1 * | 7/2005 | Stribling et al. | 220/705 |
| 2005/0242204 | A1 * | 11/2005 | Ness et al. | 239/24 |
| 2006/0201955 | A1 * | 9/2006 | Stribling et al. | 220/705 |
| 2006/0255169 | A1 * | 11/2006 | Gieson | 239/33 |
| 2007/0262164 | A1 * | 11/2007 | Gelfand | 239/33 |

OTHER PUBLICATIONS

PCT/US2010/055974 The Last Straw, "Notification of the International Search Report and Written Opinion of the International Searching Authority" (form PCT/ISA/210-220 and 237).

PCT/US2010/055974, The Last Straw, "Written Opinion" of the International Searching Authority, (Form PCT/ISA/237).

* cited by examiner

*Primary Examiner* — Darren W Gorman

(74) *Attorney, Agent, or Firm* — Cantor Colburn LLP

(57) ABSTRACT

The present invention relates to a leakage prevention straw, a method of manufacturing the leakage prevention straw, and containers employing the leakage prevention straw. In accordance with the present invention, the leakage prevention straw has an open-ended, hollow tube; an open-ended, hollow receiver sealably mounted on the tube; a valve assembly sealably engaging the receiver; and a resilient locking adapter disposed on the tube and lockingly engaging the valve assembly to secure the valve assembly in liquid seal engagement with the receiver. The valve assembly has a hollow, open-ended, resilient enclosure and a check valve disposed within the enclosure. Although the check valve is biased in a closed position, the check valve opens upon manual manipulation of the enclosure.

43 Claims, 4 Drawing Sheets

SNAP-FIT VALVE AND STRAW ASSEMBLY AND METHOD OF USING SAME

TECHNICAL FIELD OF THE INVENTION

The present invention generally relates to leakage prevention straws and containers employing the same.

BACKGROUND OF THE INVENTION

Juice boxes and pouches are well known sealed drinking containers. Typically, these containers have attached thereto a plastic straw, which can be removed and used to puncture the container and drain the liquid within. Such containers are predominantly employed by children. However, the children, through various means, often allow liquid within the container to uncontrollably escape from the straw and/or container to cause a spill.

One problem associated with conventional straws employed with sealed drinking containers is that users can force liquid out of the straw by squeezing the container. Another problem is that liquid can be extracted from the container through the straw by vacuum related capillary action. Yet, another problem with conventional straw/sealed drinking container assemblies is that users can tip the container and cause the liquid to spill. Thus, there is a need for a straw and a straw/drinking container assembly that reduces or eliminates the unwanted draining of liquid from the container. Whatever the precise merits, features, and advantages of the prior art, it does not solve these problems. Accordingly, it is to that end that the present invention is directed.

SUMMARY OF THE INVENTION

The present invention relates to a leakage prevention straw, a method of manufacturing the leakage prevention straw, and containers employing the leakage prevention straw. In accordance with the present invention, the leakage prevention straw comprises an open-ended, hollow tube; an open-ended, hollow receiving adapter sealably mounted on the tube; a valve assembly sealably engaging the receiving adapter; and resilient locking adapter disposed on the tube and lockingly engaging the valve assembly to secure the valve assembly in liquid seal engagement with the receiving adapter. The valve assembly comprises a hollow, open-ended, resilient enclosure and a check valve disposed within the enclosure that is biased in a closed position. The check valve opens upon manual manipulation or compression of the enclosure.

In one aspect of the present invention, the leakage prevention straw comprises a tube having a first tube end, a second tube end, and an open tube bore disposed between the first and second tube ends. A receiver is sealably mounted to the tube on the first tube end. The receiver has a first receiver end, a second receiver end, an open-ended receiver bore extending from the first to the second receiver ends, at least one boss, and at least one recess. A valve assembly ("VA") is engaged with the receiving adapter to form a liquid seal therebetween. The valve assembly has a hollow, resilient enclosure having a first VA end, a second VA end, a wall extending from the first to the second VA end, an open-ended enclosure bore extending from the first to the second VA end, and at least one bayonet section proximate the second VA end. The bayonet section matingly and sealably engages the at least one boss. Further, the bayonet section has an inner and an outer bayonet surface. A check valve is disposed within the enclosure that is movable from a closed position to an open position upon compression of the enclosure wall. A resilient locking adapter is disposed on the tube and comprises a first section and a second section. The first section engages the outer bayonet surface and secures the inner bayonet surface within the at least one boss. The second section has at least one protrusion positioned to matingly engage the at least one recess and secure the valve assembly in liquid sealed engagement with the receiving adapter. Further, the tube bore, the receiver bore, and the enclosure bore, define a liquid flow path within the leakage prevention straw, whereby a liquid can flow through the straw from the second end of the tube to the first end of the enclosure.

Still, in another aspect of the present invention, the leakage prevention straw comprises a tube having a first tube end, a second tube end, and an open tube bore disposed between the first and second tube ends. A receiving adapter is sealably mounted on the tube at the first tube end. The receiver comprises a first receiver end, a second receiver end, an open receiver bore extending from the first to the second receiver end, at least one boss, and at least one recess. A VA engages the receiving adapter to form a liquid seal therebetween. The VA comprises a hollow, resilient enclosure having a first VA end; a second VA end; a wall extending from the first to the second VA end; an open-ended enclosure bore extending from the first to the second VA end; and at least one bayonet section proximate the second VA end positioned to matingly and sealably engage the at least one boss. Further, the bayonet section has an inner bayonet surface and an outer bayonet surface. Disposed within the enclosure is a manually openable check valve. The check valve remains in a closed position either upon application of a vacuum force from the direction of the first VA end or a liquid pressure force from the direction of the second VA end. A resilient locking adapter is disposed on the tube and comprises first and second sections. The first section engages the outer bayonet surface and secures the inner bayonet surface within the at least one boss. The second section contains at least one protrusion positioned to matingly engage the at least one recess and secure the VA in liquid sealed engagement with the receiver. A liquid path is defined by the tube bore, the receiver bore, and the enclosure bore, whereby a liquid can flow through the straw from the second end of the tube to the first end of the enclosure.

In accordance with the present invention, a method for manufacturing the leak prevention straw is disclosed. The method comprises slidably engaging a resilient locking adapter with an open-ended, hollow tube; sealably mounting one end of an open-ended, hollow receiver onto an end of the tube; sealably engaging a valve assembly with the other end of the receiver; and engaging the locking adapter with the receiver and the valve assembly to secure the valve assembly in liquid sealed engagement with the receiver. The valve assembly is described above.

Another aspect of the present invention, the method of manufacturing the leak-resistant straw employs:

- a tube having a first tube end, a second tube end and a tube bore;
- a resilient locking adapter having first and second sections, the second section having at lease one protrusion;
- a receiver having a first receiver end, a second receiver end, an open receiver bore extending from the first to the second receiver ends, at least one boss, and at least one recess; and
- a valve assembly comprising:
  - a hollow, resilient enclosure having a first VA end, a second VA end, a wall extending from the first to the second VA end, an open-ended enclosure bore extending from the first to the second VA end, and at least one bayonet section proximate the second VA end having an inner and an outer bayonet surface; and a check valve disposed within the enclosure that is movable from a closed position to an open position upon compression of the enclosure wall.

The method comprises placing the locking adapter on the tube; sealably mounting the receiver on the tube at the first tube end; engaging the valve assembly with the receiver to form a liquid seal therebetween; and lockingly engaging the locking adapter with the receiver and the valve assembly by engaging the first section of the locking adapter with the outer bayonet surface to secure the inner bayonet surface within the at least one boss and matingly engaging the at least one protrusion of the second section of the locking adapter with the at least one recess to secure the valve assembly in liquid sealed engagement with the receiver.

In yet another aspect of the present invention, a drink carton is disclosed. The drink carton comprises a package for holding a liquid and a leakage prevention straw in accordance with the present invention operably disposed in the package for transmitting the liquid from the package through the leakage prevention straw.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the present invention. It is important, therefore, that the claims be regarded as including such equivalent constructions insofar as they do not depart from the spirit and scope of the present invention.

Other advantages and capabilities of the present invention will become apparent from the following description taken in conjunction with the accompanying drawings showing the elements and the various aspects of the present invention.

BRIEF DESCRIPTION OF THE OF DRAWINGS

The invention will be better understood and the above objects as well as objects other than those set forth above will become apparent when consideration is given to the following detailed description thereof. Such description makes reference to the annexed drawings wherein:

FIG. 1. is a detailed side cross-sectional view of the receiver;

DETAILED DESCRIPTION OF THE INVENTION

Figures 1, 2, 3:
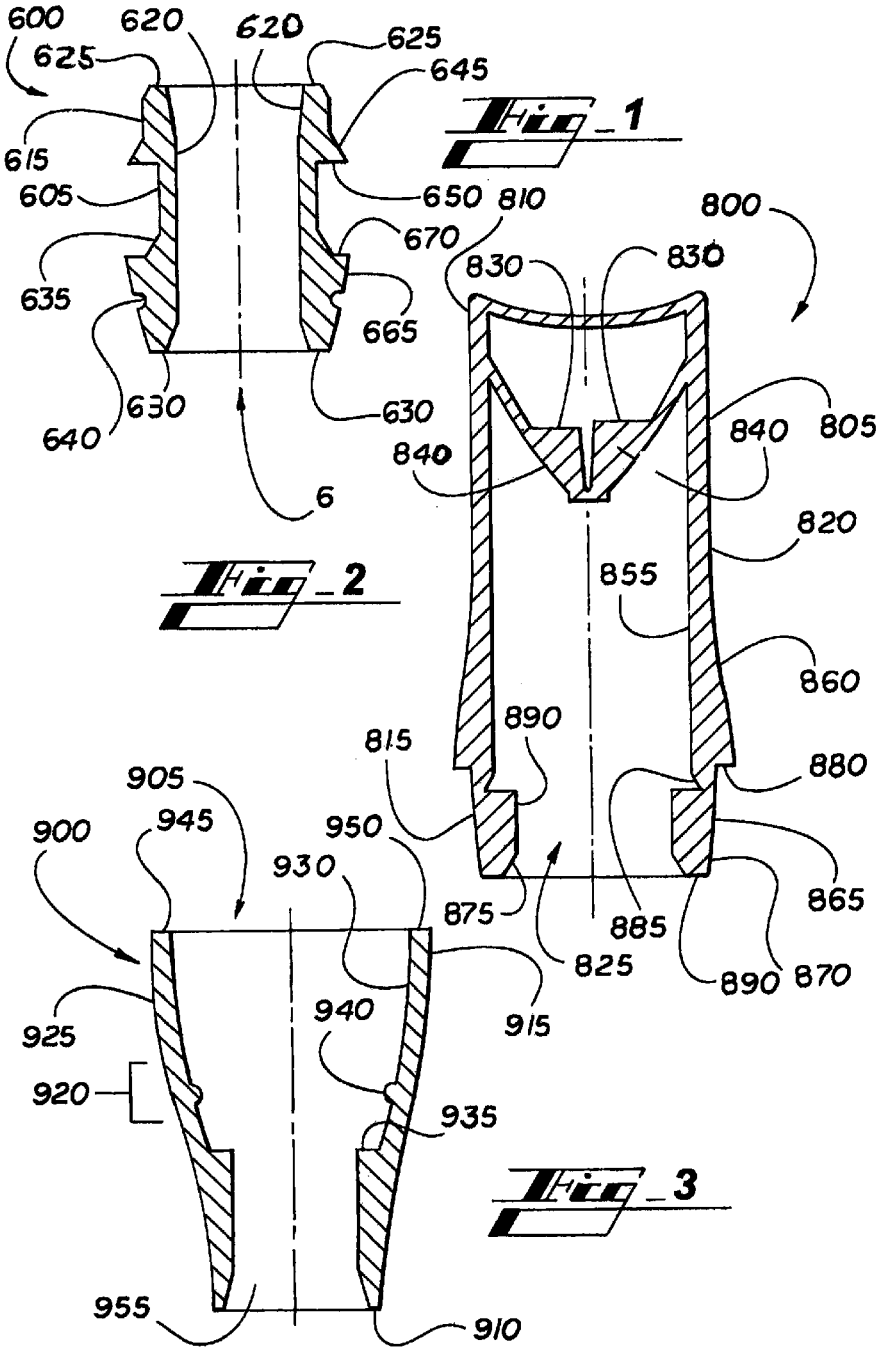
FIG. 2 is a detailed side cross-sectional view of the valve assembly.
FIG. 3 is a detailed side cross-sectional view of the locking adapter.

This invention overcomes the disadvantages of the prior art by providing a leakage prevention straw that is easy to use. In accordance with the present invention, the leakage prevention straw comprises an open-ended, hollow tube; an open-ended, hollow receiver sealably mounted on the tube; a valve assembly sealably engaging the receiver; and resilient locking adapter disposed on the tube and lockingly engaging the valve assembly to secure the valve assembly in liquid seal engagement with the receiver. The valve assembly comprises a hollow, open-ended, resilient enclosure and a check valve disposed within the enclosure that is biased in a closed position. The check valve opens upon manual manipulation or compression of the enclosure.

In one aspect of the present invention, the leakage prevention straw comprises a tube having a first tube end, a second tube end, and an open tube bore disposed between the first and second tube ends. A receiver is sealably mounted to the tube on the first tube end. The receiver has a first receiver end, a second receiver end, an open-ended receiver bore extending from the first to the second receiver ends, at least one boss, and at least one recess. A valve assembly (VA) engages receiving adapter to form a liquid seal therebetween. The valve assembly has a hollow, resilient enclosure having a first VA end, a second VA end, a wall extending from the first to the second VA end, an open-ended enclosure bore extending from the first to the second VA end, and at least one bayonet section proximate the second VA end. The bayonet section matingly and sealably engages the at least one boss. Further, the bayonet section has an inner and an outer bayonet surface. A check valve is disposed within the enclosure that is movable from a closed position to an open position upon compression of the enclosure wall. A resilient locking adapter is disposed on the tube and comprises a first section and a second section. The first section engages the outer bayonet surface and secures the inner bayonet surface within the at least one boss. The second section has at least one protrusion positioned to matingly engage the at least one recess and secure the valve assembly in liquid sealed engagement with the receiver. Further, the tube bore, the receiver bore, and the enclosure bore, define a liquid flow path within the leakage prevention straw, whereby a liquid can flow through the straw from the second end of the tube to the first end of the enclosure.

Still, in another aspect of the present invention, the leakage prevention straw comprises a tube having a first tube end, a second tube end, and an open tube bore disposed between the first and second tube ends. A receiver is sealably mounted on the tube at the first tube end. The receiver comprises a first receiver end, a second receiver end, an open-ended receiver bore extending from the first to the second receiver end, at least one boss, and at least one recess. A valve assembly engages the receiving adapter to form a liquid seal therebetween. The valve assembly comprises a hollow, resilient enclosure having a first VA end; a second VA end; a wall extending from the first to the second VA end; an open-ended enclosure bore extending from the first to the second VA end; and at least one bayonet section proximate the second VA end positioned to matingly and sealably engage the at least one boss. Further, the bayonet section has an inner bayonet surface and an outer bayonet surface. Disposed within the enclosure is a manually openable check valve. The check valve remains in a closed position either upon application of a vacuum force from the direction of the first VA end or a liquid pressure force from the direction of the second VA end. A resilient locking adapter is disposed on the tube and comprises first and second sections. The first section engages the outer bayonet surface and secures the inner bayonet surface within the at least one boss. The second section contains at least one protrusion positioned to matingly engage the at least one recess and secure the VA in liquid sealed engagement with the receiver. A liquid path is defined by the tube bore, the receiver bore, and the enclosure bore, whereby a liquid can flow through the straw from the second end of the tube to the first end of the enclosure.

In accordance with the present invention, a method for manufacturing the leak prevention straw is disclosed. The method comprises slidably engaging a resilient locking adapter with an open-ended, hollow tube; sealably mounting one end of an open-ended, hollow receiver onto an end of the tube; sealably engaging a valve assembly with the other end of the receiver; and engaging the locking adapter with the receiver and the valve assembly to secure the valve assembly in liquid sealed engagement with the receiver. The valve assembly is described above.

Another aspect of the present invention, the method of manufacturing the leak-resistant straw employs:

- a tube having a first tube end, a second tube end and a tube bore;
- a resilient locking adapter having first and second sections, the second section having at lease one protrusion;
- a receiver having a first receiver end, a second receiver end, an open receiver bore extending from the first to the second receiver ends, at least one boss, and at least one recess; and
- a valve assembly comprising:
  - a hollow, resilient enclosure having a first VA end, a second VA end, a wall extending from the first to the second VA end, an open-ended enclosure bore extending from the first to the second VA end, and at least one bayonet section proximate the second VA end having an inner and an outer bayonet surface; and
  - a check valve disposed within the enclosure that is movable from a closed position to an open position upon compression of the enclosure wall.

The method comprises placing the locking adapter on the tube; sealably mounting the receiver on the tube at the first tube end; engaging the valve assembly with the receiver to form a liquid seal therebetween; and lockingly engaging the locking adapter with the receiver and the valve assembly by engaging the first section with the outer bayonet surface to secure the inner bayonet surface within the at least one boss and engaging the at least one protrusion of the second section with the at least one recess to secure the valve assembly in liquid sealed engagement with the receiver.

In yet another aspect of the present invention, a drink carton is disclosed. The drink carton comprises a package for holding a liquid and a leakage prevention straw in accordance with the present invention operably disposed in the package for transmitting the liquid from the package through the leakage prevention straw.

DEFINITIONS

In the description below, it should be noted that the term "resilient" means that the element can return substantially to its original form after being bent, compressed, or stretched. The term "plastic" means any of various organic compounds produced by polymerization, capable of being molded, extruded, cast into various shapes and films, or drawn into filaments used as textile fibers. The term "extendable" means being able to stretch out, draw to full length.

For a fuller understanding of the nature and desired objects of this invention, reference should be made to the above and following detailed description taken in connection with the accompanying figures. When reference is made to the figures, like reference numerals designate corresponding parts throughout the several figures.

Receiver

Figure 6:
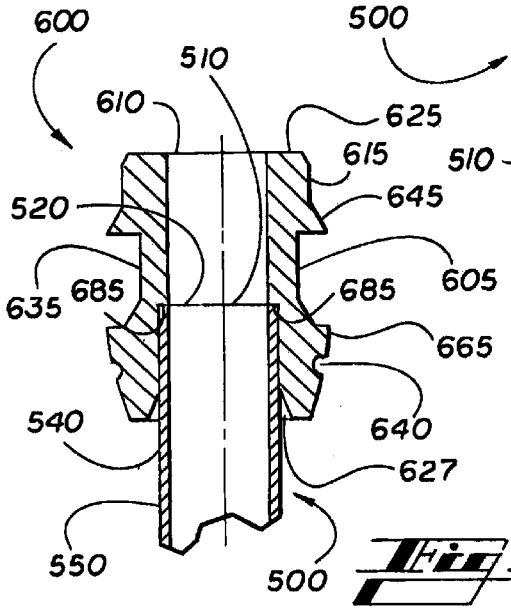
FIG. 6 is a detailed side cross-sectional view of the tube interconnected to an alternative aspect of the receiver.

Reference is made initially to FIGS. 1 and 6. FIG. 1 illustrates a side, cross-sectional view of a receiver 600 in accordance with the present invention. Receiver 600 comprises a body 605, an outer receiver surface 615, an inner receiver surface 620, a first receiver end 625, and a second receiver end 630. An open-ended receiver bore 610 extends from the first to the second receiver end 625, 630, thereby providing a central opening through the entire length of the receiver 600. Proximate the first receiver end 625 is a first receiver boss 645, which has a first boss seat 650. A second receiver boss 665 is positioned proximate the second receiver end 630. The second receiver boss 665 has a second boss seat 670. A canal 635 is disposed in the outer receiver surface 615 between the first and second receiver bosses 645 and 665. Respectively, the first and second boss seats 650 and 670 define the edges of the canal 635. A recess 640 is positioned proximate the second receiver end 630 in the outer surface 615.

FIG. 6 illustrates an alternative aspect of the present invention. In this aspect the receiving adapter 600 has a receiving section 627. The receiving section 627 is disposed within the receiver bore 610 and extends between the second receiver end 630 and a stop 685.

The receiver comprises a plastic. For example, suitable plastics include, but are not limited to, polypropylene or acrylonitrile-butadiene-styrene terpolymer (ABS).

Valve Assembly

FIG. 2 illustrates a side cross-sectional view of a valve assembly 800 in accordance with the present invention. The valve assembly 800 (VA) comprises a hollow enclosure 805 and a check valve 830 disposed within the enclosure 805. The enclosure 805 has a first VA end 810, a second VA end 815, and an enclosure wall 820 extending from the first to the second VA ends 810 and 815. An open-ended enclosure bore 825 extends through the enclosure 805 from the first to the second VA ends 810 and 815. The enclosure wall 820 has an inner wall surface 855 and an outer wall surface 860. At least one bayonet section 865 is proximate the second VA end 815. The bayonet section 865 has a outer bayonet surface 870 and a inner bayonet surface 875, and at least one bayonet lock portion 890 proximate the first VA end 810. The outer bayonet surface 870 contains a flared upper seat 880, and the inner bayonet surface 875 has an indentation 885.

The enclosure 805 is made of an elastomer. Such elastomers include, but are not limited to, natural rubber, synthetic polyisoprene, butyl rubber (copolymer of isobutylene and isoprene, IIR), halogenated butyl rubbers (chloro butyl rubber: CIIR; bromo butyl rubber: BIIR) polybutadiene, styrene-butadiene rubber (copolymer of polystyrene and polybutadiene, SBR), nitrile rubber (copolymer of polybutadiene and acrylonitrile, NBR), hydrogenated nitrile rubbers (HNBR) therban and tetpol, chloroprene rubber (CR), polychloroprene, neoprene, baypren, ethylene propylene rubber, a copolymer of ethylene and propylene) and EPDM rubber (ethylene propylene diene rubber, a terpolymer of ethylene, propylene and a diene-component), epichlorohydrin rubber (ECO), polyacrylic rubber, silicone rubber, fluorosilicone rubber, Viton, Tecnoflon, Fluorel, Aflas, Dai-El, perfluoroelastomers, tecnoflon PFR, Kalrez, Chemraz, Perlast, polyether block amides, chlorosulfonated polyethylene, Hypalon, ethylene-vinyl acetate, Elastron, Santoprene, thermoplastic Polyurethane, thermoplastic olefins, or polysulfide rubber. In another aspect of the present invention, the enclosure comprises silicone.

The check valve 830 is proximate the first VA end 810 and is positioned within the enclosure bore 825. The check valve 830 moves from a closed to an open position when a compressive force, such as a circumferentially compressive force, is applied to the enclosure 805. Such a force can be applied by a user with their lips, teeth, mouth, or fingers. If a user applies a suction force without first compressing the enclosure 805, no liquid will flow through the valve assembly 800. When the check valve 830 is in an open position, liquid communication can occur between the first and second VA ends 810 and 815 of the enclosure 805. The check valve 830 is biased in a closed position such that a pressurized force from a liquid originating from the second VA end 815 does not open the check valve. Further, the check valve 830 is biased in a closed position such that a vacuum force originating from the first VA end 810 does not open the check valve.

The check valve 830 can comprise a duckbill, crossbill, or flap configuration. A duckbill valve is a "one-way" valve typically of one-piece construction. It comprises two flexible members that resemble a "duckbill"; however, any sort, shape, number, material or variation of flaps or lips may be used. Flexible members 840 are made of an elastomeric material, and are used to prevent undesired liquid flow or leakage. As discussed above, the flexible check valve 830 (e.g. duckbill) can be opened by minimal action of a user by circumferentially compressing the valve with the consumer's mouth, fingers, teeth, or lips. The check valve 830 returns to a closed position when the force ceases.

The check valve 830 comprises a flexible, yet resilient material. Such a material can be, but not limited to, any elastomer known in the art which is flexible and resilient. For example, the material can be any of the elastomers listed in the previous paragraph. In one aspect of the present invention, the check valve comprises silicone. In another aspect of the present invention, the check valve 830 and the enclosure 805 can be made from the same or different elastomers. The check valve 830 comprises at least one flexible member which moves upon application of a circumferentially compressive force on the enclosure 805. In one aspect of the invention, depicted in FIG. 2, at least two flexible members 840 are present.

Locking Adapter

Figure 8:
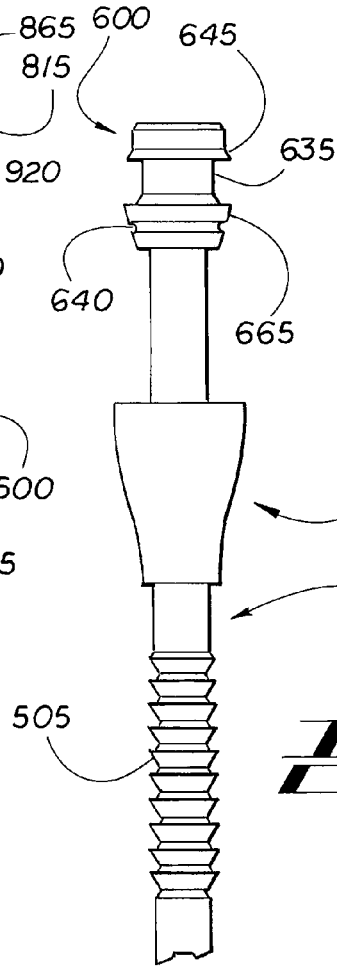
FIG. 8 is a side view illustrating the receiving adapter mounted on the tube and the locking adapter disposed on the tube.

Referring to FIGS. 3 and 8, a locking adapter 900 in accordance with the present invention is illustrated. Locking adapter 900 has a first LA end 905, a second LA end 910, an open-ended LA bore 955 extending between the first and second LA ends, a first section 915, a second section 920, an inner LA surface 930, and an outer LA surface 925. The first section 915 has a protruding member 945 and a protruding member face 950. A protrusion 940 extends outwardly from the inner LA surface 930 within the LA bore 955. Also disposed within the LA bore 955 is a LA seat 935.

The locking adapter 900 is made of a polymeric material. In one aspect, the locking adapter can be made from polyethylene terephthalate, however, in other aspects it can be made from polycarbonate, polypropylene, high impact polystyrene, acrylonitrile-butadiene-styrene, and high density polyethylene.

Leakage Prevention Straw Assembly and Drinking Carton

Figure 4:
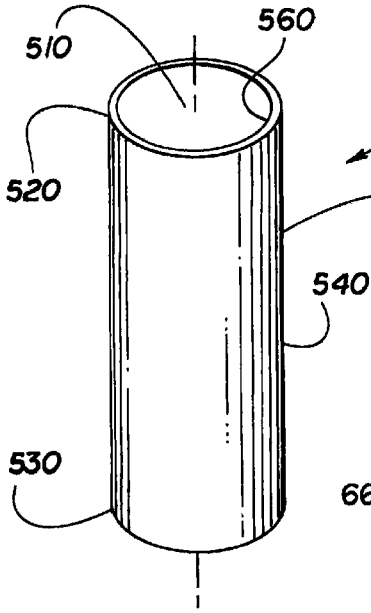
FIG. 4 is a side perspective view of the tube.
Figure 5:
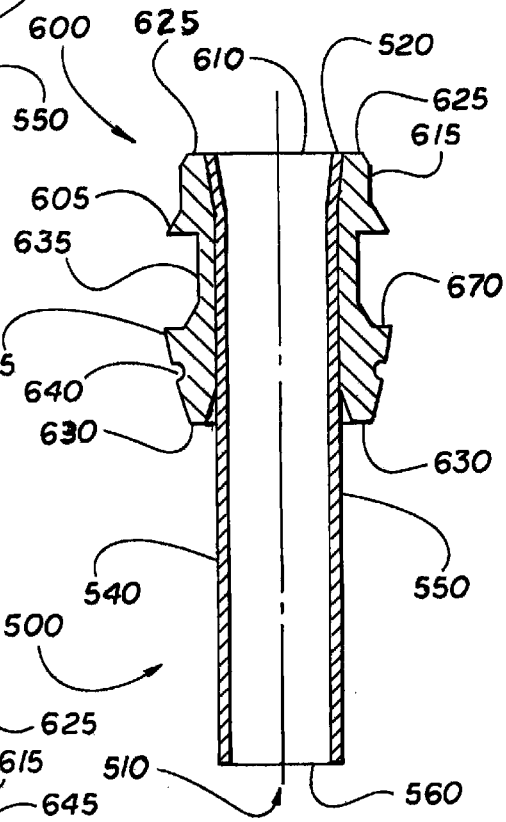
FIG. 5 is a detailed side cross-sectional view of the tube interconnected to the receiver.

FIG. 4 illustrates a perspective view of a tube 500 in accordance with the present invention. Tube 500 has a tube first end 520, a tube second end 530, and a tube wall 540 extending between the tube first and second ends 520 and 530. The tube wall 540 defines an open-ended tube bore 510 and has a tube inner surface 560 and a tube outer surface 550.

As illustrated in FIG. 8, the tube can have a flexible section 505 which allows users to withdraw liquid from the tube while the tube is bent, curved or crooked. The flexible section 505 can have corrugated folds or alternating furrows and ridges. In another aspect the tube 500 can contain an extendable section. Extendable straws are also well known in the art. The dimensions and physical properties of such straws or tubes are well known in the art. Tube or straw 500 can be manufactured from a variety of polymeric materials. Examples include but are not limited to polypropylene and ABS.

With continued reference to FIGS. 1-4 and additionally to FIGS. 5-11, the assembly of the leakage prevention straw 1 is illustrated. As provided in FIG. 8, the locking adapter 900 is placed onto the tube 500 in slidable engagement therewith by inserting the tube first end 520 through the LA bore 955 at the second LA end 910 and exiting at the first LA end 905. Alternatively, the locking adapter 900 can be placed in slidable engagement with the tube 500 by inserting the tube second end into the LA bore 955 at the first LA end 905 and exiting at the second LA end 910.

In order to mount the receiver 600 onto the tube 500, the tube first end 520 is inserted into the receiver bore 610 at the first receiver end 625. Thereafter, the received 600 is sealably mounted to tube 500. In one aspect of the present invention, the tube first end 520 is positioned proximate the first receiver end 625 within the receiver bore 610. Sealable mounting can occur by bonding or affixing the receiver 600 to the tube 500. Mounting techniques which can be employed with the present invention include, but are not limited to, over molding, mechanical attachment, sonic welding, shrink applications, friction fitting, or adhesive mounting. In one aspect of the present invention, the tube outer surface 550 and the inner surface 620 of the receiver are sealably mounted to one another by use of a bonding technique. In another aspect of the present invention, sonic welding is used to bond the tube 500 to the receiving adapter 600.

In one aspect of the present invention, the locking adapter 900 is placed onto the tube 500 prior to the receiver 600 being mounted onto the tube. In another aspect of the present invention, the locking adapter 900 is placed onto the tube 500 after the receiver 600 is mounted onto the tube.

Figure 7:
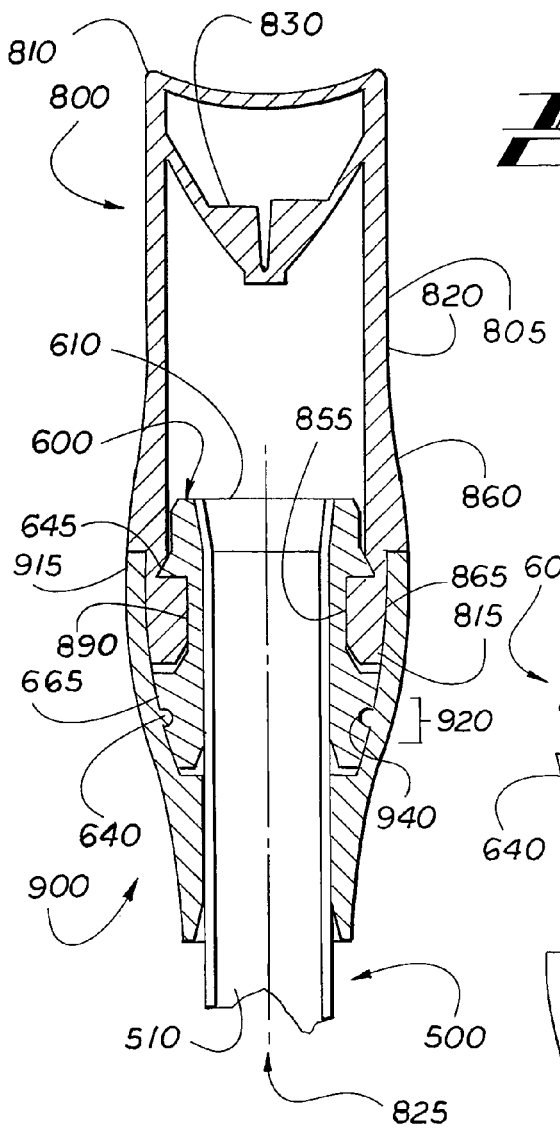
FIG. 7 is a cross-sectional view illustrating the locking adapter, receiver, and valve assembly interconnected.
Figure 9:
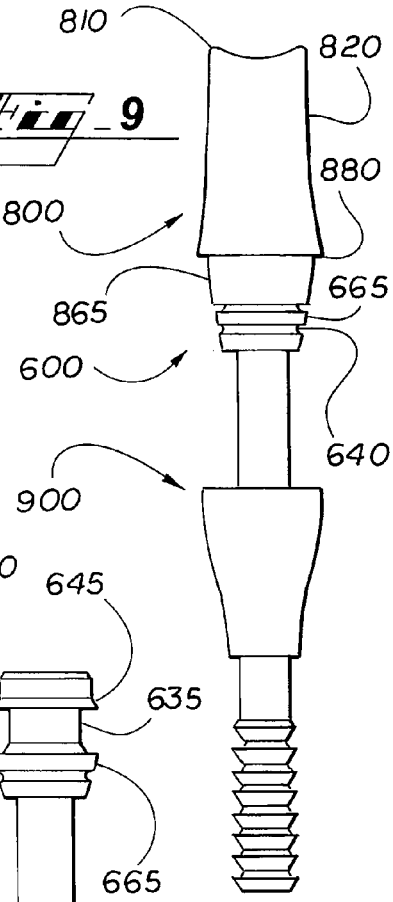
FIG. 9 is a side view of the valve assembly installed on the receiver.

As illustrated in FIGS. 7 and 9, valve assembly 800 is placed in sealable engagement with the receiver 600. The first receiver end 625 is inserted into the enclosure bore 825 at the second VA end 815 until the bayonet section 865 engages the upper boss 645 and the bayonet lock portion 890 matingly engages the canal 635 to sealably engage the enclosure 805 with the receiver 600.

Figure 10:
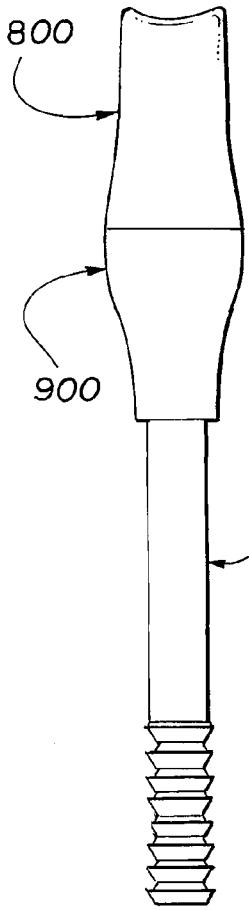
FIG. 10 is a side view of the locking adapter engaging the receiver and valve assembly.

As illustrated in FIGS. 7 and 10, the locking adapter 900 is slidably moved along the tube 500 to engage the receiver 600. The inner LA surface 930 of the first section 915 of the locking adapter 900 engages the outer receiver surface 615 at the second receiver end 630. Further, the protruding member 945 of the locking adapter 900 matingly engages the recess 640 of the receiver 600 to lock the locking adapter 900 onto the receiver 600. As indicated in FIG. 7 and illustrated in FIG. 11, the inner LA surface 930 of the first section 915 of the locking adapter 900 engages the outer wall surface 860 of the enclosure 805 to secure the valve assembly 800 in sealed engagement with the receiver 600 to form a liquid seal. A liquid flow path is defined by the tube bore 510, the receiver bore 610, and the enclosure bore 825 such that a liquid can flow through the straw or tube 500 from the tube second end 530 and exit from the enclosure first end 810.

Figure 12:
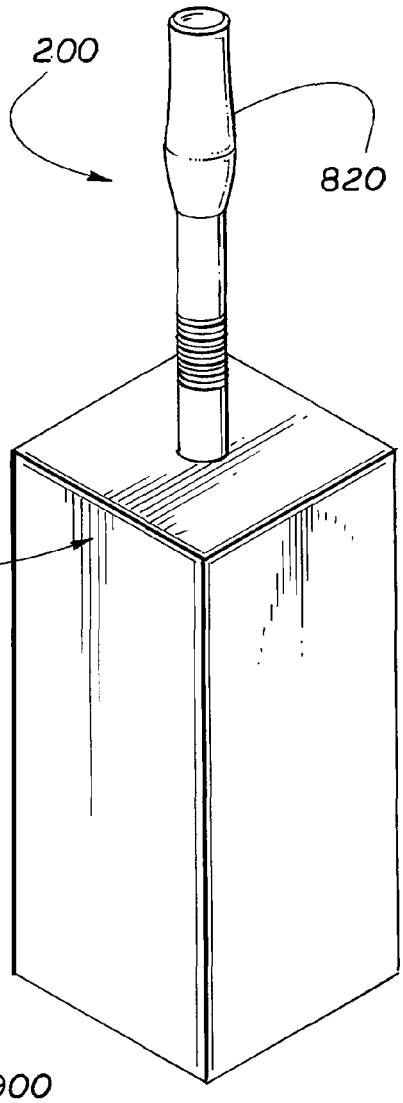
FIG. 12 is a side perspective view of the leakage prevention straw disposed in a drinking carton.
Figure 11:
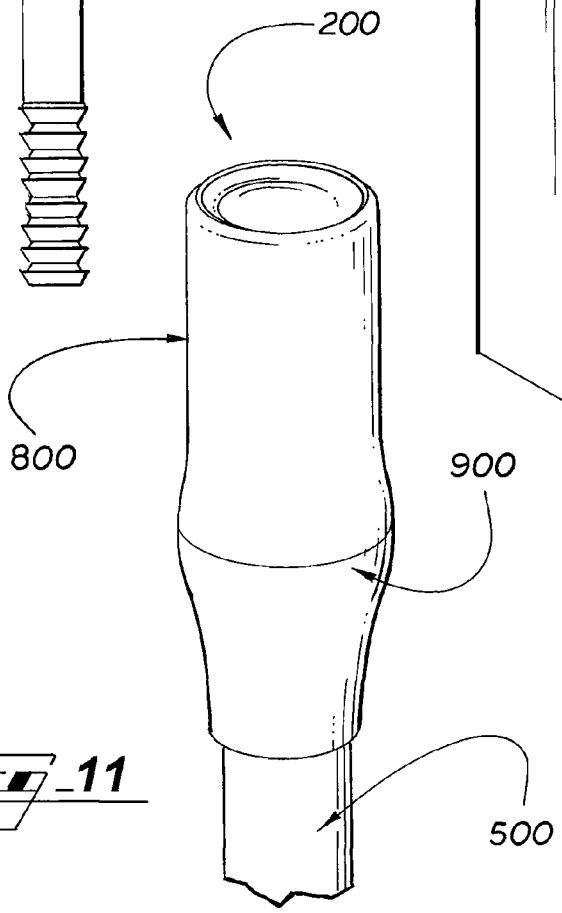
FIG. 11 is a side perspective view of the leakage prevention straw in accordance with the present invention.

Referring to FIG. 12, the leakage prevention straw 200 made in accordance with the present invention is illustrated being disposed in a drinking carton 1000. The drinking carton 1000 can have many different shapes and sizes. Drinking cartons and pouches are well known in the art. The shape of the drinking carton 1000 disclosed in FIG. 12 is not meant to be limiting. In one aspect of the present, the leakage prevention straw 200 can be disposed in cartons and pouches of different shapes and sizes. When a compressive force is placed on the enclosure wall 820, the check valve 830 opens as previously discussed. Thereafter, a user can apply either a vacuum or suction force to the leakage prevention straw 200 and/or a compressive force to the drinking carton 1000 to withdraw liquid flows from within the carton 1000 through the leakage prevention straw 200 to the user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A leakage prevention straw comprising:

a) an open-ended, hollow tube;

b) an open-ended, hollow receiver sealably mounted on the tube;

c) a valve assembly sealably engaging the receiver and comprising:

i) a hollow, open-ended, resilient enclosure and ii) a check valve disposed within the enclosure and being manually openable upon compression of the enclosure; and d) a resilient locking adapter directly engaging the tube and lockingly engaging the valve assembly to secure the valve assembly in liquid seal engagement with the receiver.

2. A drink carton comprising:

a) a package for holding a liquid and b) the leakage prevention straw as claimed in claim 1 operably disposed in the package for transmitting the liquid from the package through the leakage prevention straw.

3. A leakage prevention straw comprising:

a) a tube having a first tube end, a second tube end, and an open tube bore disposed between the first and second tube ends;

b) a receiver sealably mounted on the first tube end and having a first receiver end, a second receiver end, an open-ended receiver bore extending from the first to the second receiver ends, at least one boss, and at least one recess;

c) a valve assembly (VA) engaging the receiver to form a liquid seal therebetween and comprising:

i) a hollow, resilient enclosure having a first VA end, a second VA end, a wall extending from the first to the second VA end, an open-ended enclosure bore extending from the first to the second VA end, and at least one bayonet section proximate the second VA end positioned to matingly and sealably engage the at least one boss, the bayonet section having an inner and an outer bayonet surface, and ii) a check valve disposed within the enclosure and being movable from a closed position to an open position upon compression of the enclosure wall;

d) a resilient locking adapter directly engaging the tube and having first and second sections, the first section engaging the outer bayonet surface and securing the inner bayonet surface within the at least one boss, the second section having at least one protrusion positioned to matingly engage the at least one recess and secure the valve assembly in liquid sealed engagement with the receiver; and e) a liquid flow path defined by the tube bore, the receiver bore, and the enclosure bore, whereby a liquid can flow through the straw from the second end of the tube to the first end of the enclosure.

4. The leakage prevention straw of claim 3, wherein the tube has a flexible or an extendable portion.

5. The leakage prevention straw of claim 3, wherein the tube has a corrugated flexible portion.

6. The leakage prevention straw of claim 3, wherein the tube comprises a plastic.

7. The leakage prevention straw of claim 6, wherein the plastic is polypropylene or acrylonitrile-butadiene-styrene terpolymer.

8. The leakage prevention straw of claim 3, wherein the receiver is sonically welded to the tube.

9. The leakage prevention straw of claim 3, wherein the receiver is glued, bonded, welded, or friction fitted to the tube.

10. The leakage prevention straw of claim 3, wherein the receiver is a plastic.

11. The leakage prevention straw of claim 10, wherein the plastic is polypropylene or acrylonitrile-butadiene-styrene terpolymer.

12. The leakage prevention straw of claim 3, wherein the receiver bore has a receiving section at the second receiver end for receiving the tube and the receiving section has a stop for engaging the first tube end.

13. The leakage prevention straw of claim 3, wherein the valve assembly comprises an elastomer.

14. The leakage prevention straw of claim 3, wherein the valve assembly comprises silicone.

15. The leakage prevention straw of claim 3, wherein the enclosure comprises an elastomer.

16. The leakage prevention straw of claim 3, wherein the enclosure comprises silicone.

17. The leakage prevention straw of claim 3, wherein the check valve comprises an elastomer.

18. The leakage prevention straw of claim 3, wherein the check valve comprises silicone.

19. The leakage prevention straw of claim 3, wherein the check valve is a crossbill, duckbill, or flap valve.

20. The leakage prevention straw of claim 3, wherein the bayonet section has a bayonet lock portion extending outwardly from the inner bayonet surface to matingly and liquid sealably engage the at least one boss.

21. The leakage prevention straw of claim 3, wherein the locking adapter comprises polyethylene terephthalate, polycarbonate, polypropylene, high impact polystyrene, acrylonitrile-butadiene-styrene, or high density polyethylene.

22. A drink carton comprising:

a) a package for holding a liquid and b) the leakage prevention straw as claimed in claim 3 operably disposed in the package for transmitting the liquid from the package through the leakage prevention straw.

23. A leakage prevention straw comprising:

a) a tube having a first tube end, a second tube end, and an open tube bore disposed between the first and second tube ends;

b) a receiver sealably mounted on the first tube end and having a first receiver end, a second receiver end, an open receiver bore extending from the first to the second receiver end, at least one boss, and at least one recess;

c) a valve assembly (VA) engaging the receiving adapter to form a liquid seal therebetween and comprising:

i) a hollow, resilient enclosure having a first VA end, a second VA end, a wall extending from the first to the second VA end, an open-ended enclosure bore extending from the first to the second VA end, and at least one bayonet section proximate the second VA end positioned to matingly and sealably engage the at least one boss, the bayonet section having an inner and an outer bayonet surface, and ii) a manually openable check valve disposed within the enclosure which remains in a closed position when subjected either to a vacuum force from the direction of the first VA end or a liquid pressure force from the direction of the second VA end;

d) a resilient locking adapter directly engaging the tube and having first and second sections, the first section engaging the outer bayonet surface and securing the inner bayonet surface within the at least one boss, the second section having at least one protrusion positioned to engage the at least one recess and secure the valve assembly in liquid sealed engagement with the receiver; and e) a liquid flow path defined by the tube bore, the receiver bore, and the enclosure bore, whereby a liquid can flow through the straw from the second end of the tube to the first end of the enclosure.

24. The leakage prevention straw of claim 23, wherein the tube has a flexible or extendable portion.

25. The leakage prevention straw of claim 23, wherein the tube has a corrugated flexible portion.

26. The leakage prevention straw of claim 23, wherein the tube comprises a plastic.

27. The leakage prevention straw of claim 26, wherein the plastic is polypropylene or acrylonitrile-butadiene-styrene terpolymer.

28. The leakage prevention straw of claim 23, wherein the receiver is sonically welded to the tube.

29. The leakage prevention straw of claim 23, wherein the receiver is glued, bonded, welded, or friction fitted to the tube.

30. The leakage prevention straw of claim 23, wherein the receiver comprises a plastic.

31. The leakage prevention straw of claim 30, wherein the plastic is polypropylene or acrylonitrile-butadiene-styrene terpolymer.

32. The leakage prevention straw of claim 23, wherein the receiver bore has a receiving section at the second receiver end for receiving the tube, and the receiving section has a stop for engaging the first tube end.

33. The leakage prevention straw of claim 23, wherein the valve assembly comprises an elastomer.

34. The leakage prevention straw of claim 23, wherein the valve assembly comprises silicone.

35. The leakage prevention straw of claim 23, wherein the enclosure comprises an elastomer.

36. The leakage prevention straw of claim 23, wherein the enclosure comprises silicone.

37. The leakage prevention straw of claim 23, wherein the check valve comprises an elastomer.

38. The leakage prevention straw of claim 23, wherein the check valve is a crossbill, duckbill, or flap valve.

39. The leakage prevention straw of claim 23, wherein the bayonet section has at least one bayonet lock portion extending outwardly from the inner bayonet surface to matingly and sealably engage the at least one boss.

40. The leakage prevention straw of claim 23, wherein the locking adapter comprises polyethylene terephthalate, polycarbonate, polypropylene, high impact polystyrene, acrylonitrile-butadiene-styrene, or high density polyethylene.

41. A drink carton comprising:

a) a package for holding a liquid and b) the leakage prevention straw as claimed in claim 23 operably disposed in the package for transmitting the liquid from the package through the leakage prevention straw.

42. A method for making a leak prevention straw comprising:

a) slidably engaging a resilient locking adapter with an open-ended, hollow tube;

b) sealably mounting one end of an open-ended, hollow receiver onto an end of the tube;

c) sealably engaging a valve assembly with the other end of the receiver, the valve assembly comprising:

i) a hollow, open-ended, resilient enclosure and ii) a check valve disposed within the enclosure and being manually openable upon compression of the enclosure; and d) engaging the locking adapter with the receiver and the valve assembly to secure the valve assembly in liquid sealed engagement with the receiver, wherein the locking adapter has direct engagement with the tube.

43. A method for making a leak-resistant straw comprising:

a) placing a resilient locking adapter on a tube, the locking adapter having first and second sections and the second section having at least one protrusion, the tube having a first tube end, a second tube end, and a tube bore;

b) sealably mounting a receiver on the first tube end, the receiver having a first receiver end, a second receiver end, an open receiver bore extending from the first to the second receiver ends, at least one boss, and at least one recess;

c) engaging a valve assembly (VA) with the receiver to form a liquid seal therebetween, the valve assembly comprising:

i) a hollow, resilient enclosure having a first VA end, a second VA end, a wall extending from the first to the second VA end, an open-ended enclosure bore extending from the first to the second VA end, and at least one bayonet section proximate the second VA end positioned to matingly and sealably engage the at least one boss, the bayonet section having an inner and an outer bayonet surface, and ii) a check valve disposed within the enclosure and being movable from a closed position to an open position upon compression of the enclosure wall; and d) lockingly engaging the locking adapter with the receiver and the valve assembly to secure the valve assembly in liquid sealed engagement with the receiver, the first section engaging the outer bayonet surface to secure the inner bayonet surface within the at least one boss and the at least one protrusion of the second section engaging the at least one recess to secure the valve assembly in liquid sealed engagement with the receiver, wherein the locking adapter has direct engagement with the tube.

* * * * *